United States Patent [19]

Petrini et al.

[11] Patent Number: 4,482,517

[45] Date of Patent: Nov. 13, 1984

[54] METHOD AND EQUIPMENT FOR PRODUCING SOLID GRANULES OF PITCH IN THE FORM OF CYLINDERS CRUSHED AT THE ENDS

[75] Inventors: Valentino Petrini; Stefano Preda, both of Milan, Italy

[73] Assignee: Carbochimica Italiana S.p.A., Milan, Italy

[21] Appl. No.: 389,997

[22] Filed: Jun. 18, 1982

[30] Foreign Application Priority Data

Sep. 7, 1981 [IT] Italy ..... 23815 A/81

[51] Int. Cl.[3] ..... B02C 1/02

[52] U.S. Cl. ..... 264/143; 264/178 R; 264/178 F

[58] Field of Search ..... 264/29.2, 143, 144, 264/178 R, 178 F; 428/378 R

[56] References Cited

U.S. PATENT DOCUMENTS

| | | | |
|---|---|---|---|
| 3,334,167 | 8/1967 | Kenney | 264/178 R |
| 3,491,177 | 1/1970 | Johnson | 264/143 |
| 3,972,968 | 8/1976 | Kohn | 264/178 F |
| 3,997,654 | 12/1976 | Kölling et al. | 264/29.2 |

*Primary Examiner*—Paul Lieberman
*Assistant Examiner*—W. Thompson
*Attorney, Agent, or Firm*—Ladas & Parry

[57] ABSTRACT

The pitch is extruded at a suitable temperature through cylindrical nozzles. At the exit from these nozzles the pitch is lowered into water, where a cutter divides it into granules which, deposited on a conveyer belt, remain immersed long enough to permit suitable cooling. Then they undergo drying by hot jets of air.

3 Claims, 2 Drawing Figures

Figure 1:
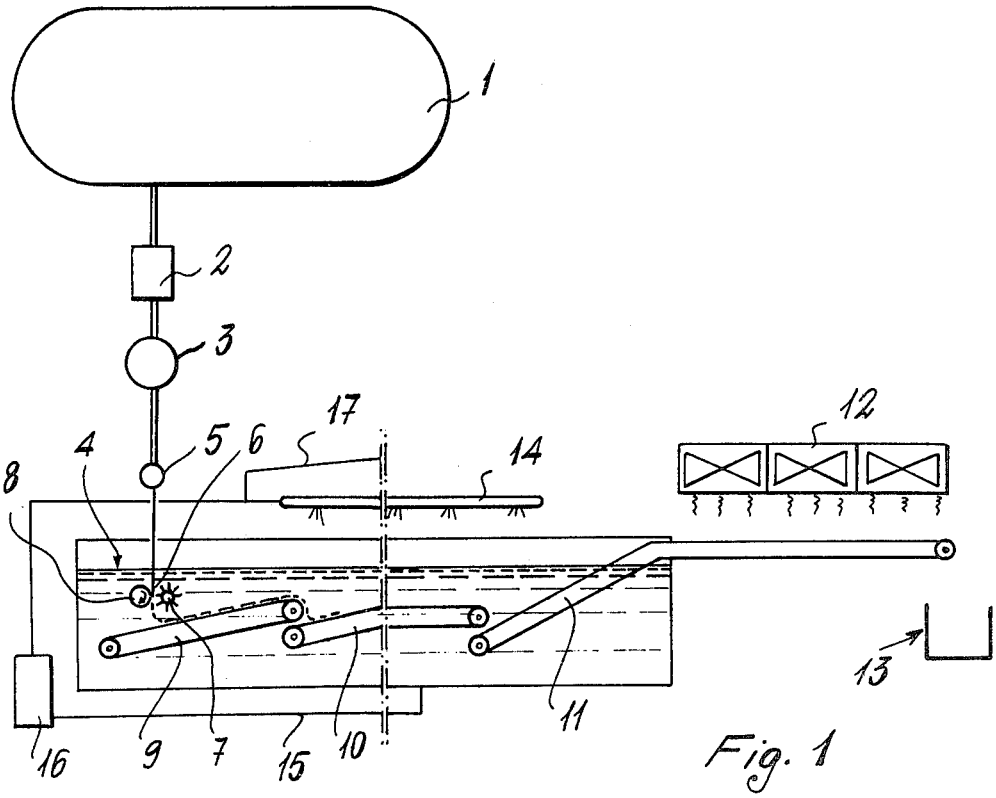

METHOD AND EQUIPMENT FOR PRODUCING SOLID GRANULES OF PITCH IN THE FORM OF CYLINDERS CRUSHED AT THE ENDS

The present invention proposes a method, and relative equipment, for producing granules of solid pitch in the shape of small cylinders crushed at the ends. The method, according to the invention, permits production of various size granules, with almost total elimination of retained humidity, and without formation and dispersion and dust in the environment.

The particular shape of the granules, smooth and without roughness and sharp edges, permits easier elimination of surface humidity.

As is known one of the problems to be solved in the production of granules of pitch is the elimination of the humidity, which can adhere to the surface or be retained in pockets formed inside the pitch following, for example, non-gradual and non-uniform cooling.

Another problem is to eliminate dust which, in several known production systems, is generated and spreads throughout the environment. In many pitch production plants the pitch, extruded in the shape of a dough-like mass by special nozzles, is subdivided into granules and left to fall on a steel belt, where it is cooled above by jets of air and below by water which sprays against the bottom side of the belt. The effectiveness of this cooling system is rather limited, however, and as a consequence granule dimensions are also limited. In other presently utilized plants the molten pitch is poured on belts of stainless steel and cooled by immersion in water: the pitch is thus solidified in wide slabs which must be crushed, creating a great deal of dust and powder. In still other plants the molten pitch is extruded and then left to fall in a basin full of water, several meters deep, and on the bottom of this basin the long segments of solidified pitch are unevenly crushed by a screw, again creating a great deal of powder.

Often the pitch segments have a cavity inside, which fills with water.

Prevention of powder formation is good policy, because when wet it retains a substantial amount of water, and when dry it spreads throughout the environment, causing obvious ecological damages.

Another problem to solve is to prevent formation of bubbles inside the granules. Generally these bubbles are formed following brusque variations in temperature, and often contain a certain amount of humidity, which must be eliminated. The present invention, to solve these problems, proposes a method and relative equipment that obtains pitch granules free of internal bubbles and in shapes that permit simple elimination of surface humidity.

This method also avoids producing and spreading powder and dust throughout the environment.

To this end this method, according to the invention, provides for extrusion of the pitch in the shape of a tang, which goes into water and is cut into segments of the desired length by a suitable cutter. When cooling has finished the segments are dried by a jet of hot air.

Extrusion and subsequent immediate immersion in water permits production of even large size granules. Also, thanks to the special type of cooling emplyed, these granules are prevented from adhering to each other, preventing formation of conglomerates of pitch.

In addition the granules obtained in this manner take on the shape of cylinders crushed at their ends, which is also an object of the invention and which permits easy elimination of surface humidity due to the absence of roughness or surface deformations.

Figure 2:
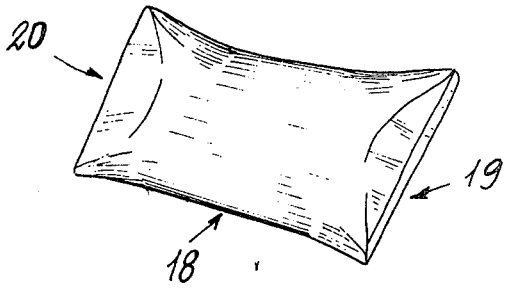

The present invention shall now be described in detail, in a non-limiting guideline example, with special reference to the enclosed figures, where:

FIG. 1 schematically illustrates a pitch granule production plant according to the invention;

FIG. 2 illustrates the shape of the granules produced according to the invention.

With reference to FIG. 1, the molten pitch coming from container 1 passes through pre-cooling plant 2, of a known type, and goes from here to recipient 3, which is kept at a constant level.

From recipient 3 it descends to a horizontal distribution pipe 5 which carries a series of variable-flow nozzles regulated by male cocks, not shown. An equal number of pitch ropes 6 flow out from these and are immersed in the water tank below, where they descend vertically towards a cutter immersed in the water.

The immersion depth of the cutter is calculated so that the pitch ropes, extruded in the liquid state, have enough time, as they descend in the water along a vertical length, to start cooling and take on a dough-like, soft consistency. The ropes reach the cutter in this condition. The cutter basically consists of cylinder 7, which rotates around its own axis, and which carries a series of longitudinal blades which, during cylinder rotation, cut ropes 6 against a backing surface which, in the example illustrated, consists of cylinder 8, rotating at a speed slightly different from the speed of cylinder 7.

Consequently ropes 6, cylindrical in shape, are subdivided into many segments which, because of the pressure exerced by the blades of cylinder 7 during cutting operations, take on the shape illustrated in FIG. 2, where the granule consists of a body with a rounded central portion 18 and ends 19 and 20 crushed.

Cylinder 7 (FIG. 1) is hollow, with an internal flow of water. This water exits from a series of holes made between the blades, helping to detach and remove the pitch segments as they are cut.

These segments fall on belt conveyor 9, placed below, and from here they fall on second belt conveyor 10, which is also totally immersed in the water. It is an advantage if the two belts, 9 and 10, have different speeds, with the first belt faster. This prevents the granules from coming in contact with each other during the first cooling phase when their temperature is still high, and prevents them from sticking together.

The granules are then dumped on belt 11 made of steel mesh. This belt exits from tank 4, passing below a series of blowers 12 or similar devices, and dumps the granules into collection containers 13 or similar devices. Tank 4 is also equipped with a water discharged, recycle and refill system consisting of pipeline 15 through which the water coming from the tank goes through a filtration and cooling system 16, and then goes to spray device 14, or similar device, for return to the tank.

Another pipe 17, coming from the water mains, also terminates at device 14, for introduction of refill water.

The operation of a plant of the type illustrated shall now be described, using the particular example of a plant processing pitch for electrodes. It remains understood that the plant, by opportunely varying the heat and/or size parameters indicated, can be utilized to process other types of pitch, or other materials.

The pitch comes from container 1 at a temperature of approximately 350° C.

From container 1 the pitch passes through pre-cooling plant 2, functioning by oil circulation, and sized to cool the pitch to a temperature of approximately 170° C.

Experimentation has shown that, with the cooling water in tank 4 at approximately 28°-35° C., the optimum temperature for the pitch at the time of extrusion is about 70° C. above sotfening point K.S.

For electrode pitch this temperature is about 170° C. Pre-cooling must be slow and gradual. The too rapid removal of heat may cause excessive cooling of the pitch on the surfaces of the pipes the pitch flows in, causing formation of a solid surface layer. This layer will impede proper pitch flow, preventing further even cooling.

The pitch, from feeder 3 at the proper temperature, passes into horizontal pipe 5, which carries nozzles with approximate 20 mm. diameters, and which have flow control devices. Cutter 7 divides tangs 6 into many segments each approximately 4 cm. long, which fall on belt 9. The speed of this belt is high enough to prevent the granules from lumping together or coming in contact with each other during initial cooling phases.

At the end of this first cooling phase, which lasts in proportion to the length of belt 9, the granules have enough surface solidity to prevent them from adhering to each other when they come in contact, and can be dumped on belt 10, which advances at a slower speed, permitting granules to remain in the cooling water longer (about 5-10 minutes) and still keep belt 10 and tank 4 dimensions down. As has already been stated, the optimum temperature of the water was calculated, by experimentation, to be about 28°-35° C.

The water, taken from tank 4 through pipeline 15, is cooled and filtered by plant 16, of known technology, and then put back in circulation through distribution pipeline 14. Pipeline 17, connected to the water mains, refills the tank to account for any water losses, keeping the level inside tank 4 constant.

At the end of the cooling period the granules are deposited on belt 11, which exits from the tank and carries the granules below a series of blowers 12, which dry them.

To facilitate this operation it is best to make belt 11 out of steel mesh.

The temperature of the air coming from the blowers is approximately 60° C. The blowers are preferably of the finned tube steam heat exchanger type.

When the parameters indicated are followed it is possible to properly cool the pitch granules without causing formation of bubbles inside them, which can be the cause of further humidity retention.

Formation of surface crinkles is also prevented, and the granules produced have a smooth and round surface, without roughness or uneveness that can make final drying difficult. Obviously an expert in this industrial sector can make numerous modifications and variations, which, however, are all to be held to come within the range of the present invention.

What is claimed is:

1. A method for manufacturing of solid pitch granules substantially free from cavities, airpockets, surface corrugations and surface irregularities comprising the following steps:

(a) melting a pitch;

(b) pre-cooling the molten pitch down to a temperature of approximately 70° C. above a softening point of said pitch;

(c) producing of a pitch rope from said pre-cooled pitch by extruding said pre-cooled pitch through calibrated nozzle means;

(d) cooling of said calibrated extruded pitch rope in a cooling fluid;

(e) cutting of said pitch rope on granules by passing said pitch rope between rotatable cutting means having a base portion and a plurality of blade portions extending radially and outwardly from said base portion and a rotatable supporting member situated substantially within a vicinity of said cutting means;

(f) final cooling of said granules in the cooling fluid; and (g) drying of said granules.

2. The method according to claim 1 wherein a pitch extrusion temperature is in a range between +140° to +190° C. and the cooling fluid temperature is between 28° C. and 35° C.

3. The method according to claim 1 wherein the produced granules have a cylindrical configuration with both ends crushed.

* * * * *